US006820970B2

(12) United States Patent
Long

(10) Patent No.: US 6,820,970 B2
(45) Date of Patent: Nov. 23, 2004

(54) CONTINUOUS INK JET CATCHER HAVING DELIMITING EDGE AND INK ACCUMULATION BORDER

(75) Inventor: Michael Long, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 9 days.

(21) Appl. No.: 10/001,027

(22) Filed: Nov. 2, 2001

(65) Prior Publication Data

US 2003/0085964 A1 May 8, 2003

(51) Int. Cl.[7] ..... B41J 2/02
(52) U.S. Cl. ..... 347/73
(58) Field of Search ..... 347/90, 34, 74–75, 347/77–80, 82

(56) References Cited

U.S. PATENT DOCUMENTS

| | | | | | |
|---|---|---|---|---|---|
| 3,373,437 | A | | 3/1968 | Sweet | 347/74 |
| 3,836,914 | A | * | 9/1974 | Duffield | 347/90 |
| 3,893,623 | A | | 7/1975 | Toupin | |
| 4,024,548 | A | * | 5/1977 | Alonso et al. | 347/34 |
| 4,035,811 | A | * | 7/1977 | Paranjpe | 347/90 |
| 4,184,167 | A | | 1/1980 | Vandervalk | |
| 4,338,613 | A | | 7/1982 | Cruz-Uribe | 347/82 |
| 4,442,440 | A | | 4/1984 | Elchinger | 347/74 |
| 4,460,903 | A | | 7/1984 | Guenther et al. | 347/90 |
| 4,573,057 | A | | 2/1986 | Sutera et al. | 347/74 |
| 4,639,736 | A | | 1/1987 | Jochimsen | 347/74 |
| 4,667,207 | A | | 5/1987 | Sutera et al. | 347/90 |
| 4,757,328 | A | | 7/1988 | Braun et al. | 347/90 |
| 4,839,664 | A | | 6/1989 | Archer et al. | 347/90 |
| 5,105,205 | A | | 4/1992 | Fagerquist | 347/90 |
| 5,337,071 | A | | 8/1994 | East et al. | |
| 5,469,202 | A | | 11/1995 | Stephens | 347/90 |
| 6,079,821 | A | | 6/2000 | Chwalek et al. | 347/82 |
| 6,517,197 | B2 | * | 2/2003 | Hawkins et al. | 347/74 |

* cited by examiner

*Primary Examiner*—K. Feggins
(74) *Attorney, Agent, or Firm*—William R. Zimmerli

(57) ABSTRACT

A catcher is provided. The catcher includes a body made from a porous material and having a first, second, and third portion. The first portion of the body defines a delimiting edge. The second portion of the body defines an area recessed from the delimiting edge. The third portion of the body is positioned adjacent to the second portion of the body and extends away from the recessed area such that the second portion of the body and the third portion of the body form an ink accumulation area.

38 Claims, 12 Drawing Sheets

CONTINUOUS INK JET CATCHER HAVING DELIMITING EDGE AND INK ACCUMULATION BORDER

CROSS REFERENCE TO RELATED APPLICATIONS

Reference is made to U.S. Ser. No. 10/000,892, entitled Continuous Ink Jet Catcher Having Delimiting Edge, filed concurrently herewith, in the name of Michael Long and Ravi Sharma.

FIELD OF THE INVENTION

This invention relates generally to the field of digitally controlled printing devices, and in particular to continuous ink jet printers in which a liquid ink stream breaks into drops, some of which are selectively collected by a catcher and prevented from reaching a recording surface while other drops are permitted to reach a recording surface.

BACKGROUND OF THE INVENTION

Traditionally, digitally controlled inkjet printing capability is accomplished by one of two technologies. Both technologies feed ink through channels formed in a printhead. Each channel includes at least one nozzle from which drops of ink are selectively extruded and deposited upon a recording surface.

The first technology, commonly referred to as "drop-on-demand" ink jet printing, provides ink drops for impact upon a recording surface using a pressurization actuator (thermal, piezoelectric, etc.). Selective activation of the actuator causes the formation and ejection of a flying ink drop that crosses the space between the printhead and the print media and strikes the print media. The formation of printed images is achieved by controlling the individual formation of ink drops, as is required to create the desired image. Typically, a slight negative pressure within each channel keeps the ink from inadvertently escaping through the nozzle, and also forms a slightly concave meniscus at the nozzle, thus helping to keep the nozzle clean.

Conventional "drop-on-demand" ink jet printers utilize a pressurization actuator to produce the ink jet drop at orifices of a print head. Typically, one of two types of actuators are used including heat actuators and piezoelectric actuators. With heat actuators, a heater, placed at a convenient location, heats the ink causing a quantity of ink to phase change into a gaseous steam bubble that raises the internal ink pressure sufficiently for an ink drop to be expelled. With piezoelectric actuators, an electric field is applied to a piezoelectric material possessing properties that create a mechanical stress in the material causing an ink drop to be expelled. The most commonly produced piezoelectric materials are ceramics, such as lead zirconate titanate, barium titanate, lead titanate, and lead metaniobate.

The second technology, commonly referred to as "continuous stream" or "continuous" ink jet printing, uses a pressurized ink source which produces a continuous stream of ink drops. Conventional continuous ink jet printers utilize electrostatic charging devices that are placed close to the point where a filament of working fluid breaks into individual ink drops. The ink drops are electrically charged and then directed to an appropriate location by deflection electrodes having a large potential difference. When no print is desired, the ink drops are deflected into an ink capturing mechanism (catcher, interceptor, gutter, etc.) and either recycled or disposed of. When print is desired, the ink drops are not deflected and allowed to strike a print media. Alternatively, deflected ink drops may be allowed to strike the print media, while non-deflected ink drops are collected in the ink capturing mechanism.

U.S. Pat. No. 4,460,903, which issued to Guenther et al. on Jul. 17, 1994, illustrates a catcher assembly that attempts to minimize splattering and misting. However, as the ink drops first strike and collect on a hard surface of the catcher, the potential for splattering and misting still exists. Additionally, this catcher assembly incorporates an oblique blade edge to initially capture the non-printed ink drops. The incoming non-printed ink drop velocity (typically approaching 10 m/s) is high enough to at least partially obstruct the preferred drop flow direction along the oblique blade edge causing at least a portion of the collected drop volume to flow in a direction opposite to the preferred deflection direction. As the drop volume flows up to the edge of the oblique blade, the effective position of the blade edge is altered increasing the uncertainty as to whether a non-printed ink drop will be captured. Additionally, ink drops that have built up on the blade edge of the catcher can be "flung" onto the receiving media by the movement of the printhead.

U.S. Pat. No. 3,373,437, which issued to Sweet et al. on Mar. 12, 1968, illustrates a catcher assembly that incorporates a planer porous cover member in an attempt to minimize splattering and misting. However, this type of catcher affects print quality in other ways. The need to create an electric charge on the catcher surface complicates the construction of the catcher and it requires more components. This complicated catcher structure requires large spatial volumes between the printhead and the media, increasing the ink drop trajectory distance. Increasing the distance of the drop trajectory decreases drop placement accuracy and affects the print image quality. There is a need to minimize the distance the drop must travel before striking the print media in order to insure high quality images.

The combination electrode and gutter disclosed by Sweet et al. creates a long interaction area in the ink drop trajectory plane. As such, the porous gutter is much longer in this plane than is required for the guttering function. This causes an undesirable extraneous air flow that can adversely affect drop placement accuracy. Additionally, as the Sweet gutter is planer in the ink drop trajectory plane, there is no collection area for ink drops removed from the ink drop path. As collected drops build up on the planer surface of the Sweet gutter, the potential for collected drops to interfere with non-collected drops increases. Additionally, the build up of collected drops creates a new interaction surface that is continually changing in height relative to the planer surface of the gutter effectively creating less of a definitive discrimination edge between printing and non-printing drops. This increases the potential for collecting printing drops while not collecting non-printing drops.

U.S. Pat. No. 4,667,207, which issued to Sutera et al. on May 19, 1987, discloses a gutter having an ink drop deflection surface positioned above a primary ink drop collection surface. Both surfaces are made from a non-porous material. The need to create an electric charge potential between the ink drops and the catcher surface complicates the construction of the catcher and it requires more components. This complicated catcher structure requires large spatial volumes between the printhead and the media, increasing the ink drop trajectory distance. Increasing the distance of the drop trajectory decreases drop placement accuracy and affects the print image quality. Additionally, there is no collection area for ink drops removed from the ink drop path in the catcher disclosed by Sutera et al. Collected drops build up on the planer and inclined surfaces of Sutera et al. gutter and move downward toward a vacuum channel positioned at the bottom edge of the catcher. At this point, ink begins to collect on the inclined surface of the catcher creating a region having a thick dome shaped ink surface. The potential for collected drops to interfere with non-collected drops in this region increases. Additionally, the build up of collected drops creates a new interaction surface that is continually changing in height relative to the surface of the gutter effectively creating less of a definitive discrimination edge between printing and non-printing drops. This increases the potential for collecting printing drops while not collecting non-printing drops.

Catcher assemblies, like the one disclosed by Sweet et al. and Sutera et al., also commonly apply a vacuum at one end of an ink removal channel to assist in removing ink build up on the catcher surface in order to minimize the amount of ink that can be flung onto the media. However, air turbulence created by the vacuum decreases drop placement accuracy and adversely affects the print quality image.

It can be seen that there is a need to provide a simply constructed catcher that reduces ink splattering and misting, minimizes the distance the drop must travel before striking the print media, and increases ink fluid removal without affecting ink drop trajectory.

SUMMARY OF THE INVENTION

According to one aspect of the invention, a catcher includes a body made from a porous material and having a first, second, and third portion. The first portion of the body defines a delimiting edge. The second portion of the body defines an area recessed from the delimiting edge. The third portion of the body is positioned adjacent to the second portion of the body and extends away from the recessed area such that the second portion of the body and the third portion of the body form an ink accumulation area.

According to another aspect of the invention, a catcher includes a body having delimiting edge made from a porous material, a recessed area made from a porous material, and a border made from a porous material. The recessed area is positioned between the delimiting edge and the border.

According to another aspect of the invention, an apparatus for printing an image includes a printhead with a portion of the printhead defining a nozzle. A droplet forming mechanism is positioned proximate to the nozzle and is operable to eject an ink droplets along a droplet path. A droplet steering mechanism is positioned proximate to the droplet path and is operable to apply a force to the ink droplets travelling along the droplet path. The force is applied such that the ink droplet begins travelling along one of a printing droplet path and a non-printing droplet path. A catcher is positioned in the non-printing droplet path spaced apart from the droplet steering mechanism. The catcher includes a body having delimiting edge made from a porous material, a recessed area made from a porous material, and a border made from a porous material. The recessed area is positioned between the delimiting edge and the border.

According to another aspect of the invention, a method of manufacturing a catcher includes providing a body; forming a delimiting edge on a first portion of the body, the delimiting edge being made from a porous material; forming a recessed area on a second portion of the body adjacent to the delimiting edge, the recessed area being made from a porous material; and forming a border on a third portion of the body adjacent to the recessed area, the border being made from a porous material.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1A:
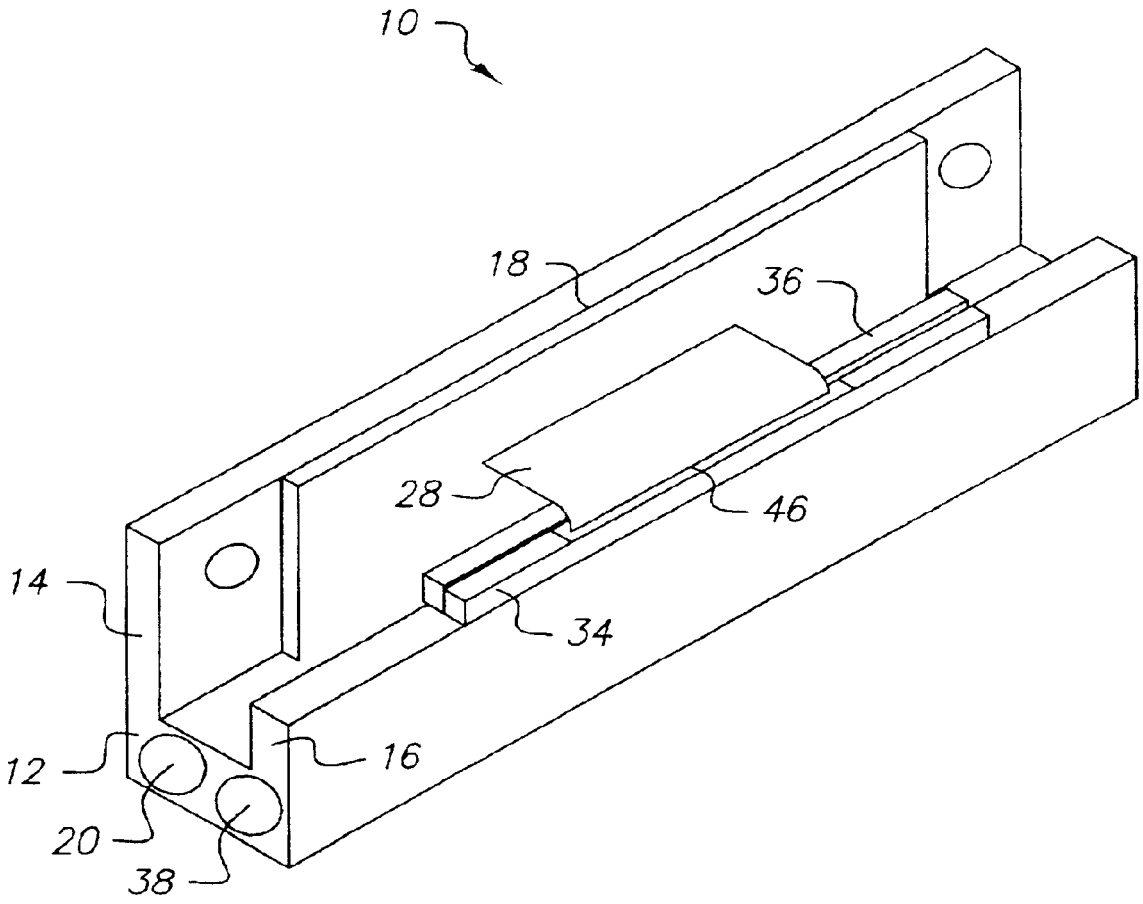
FIG. 1A is a perspective view of one preferred embodiment of the present invention attached to a printhead.
Figure 1B:
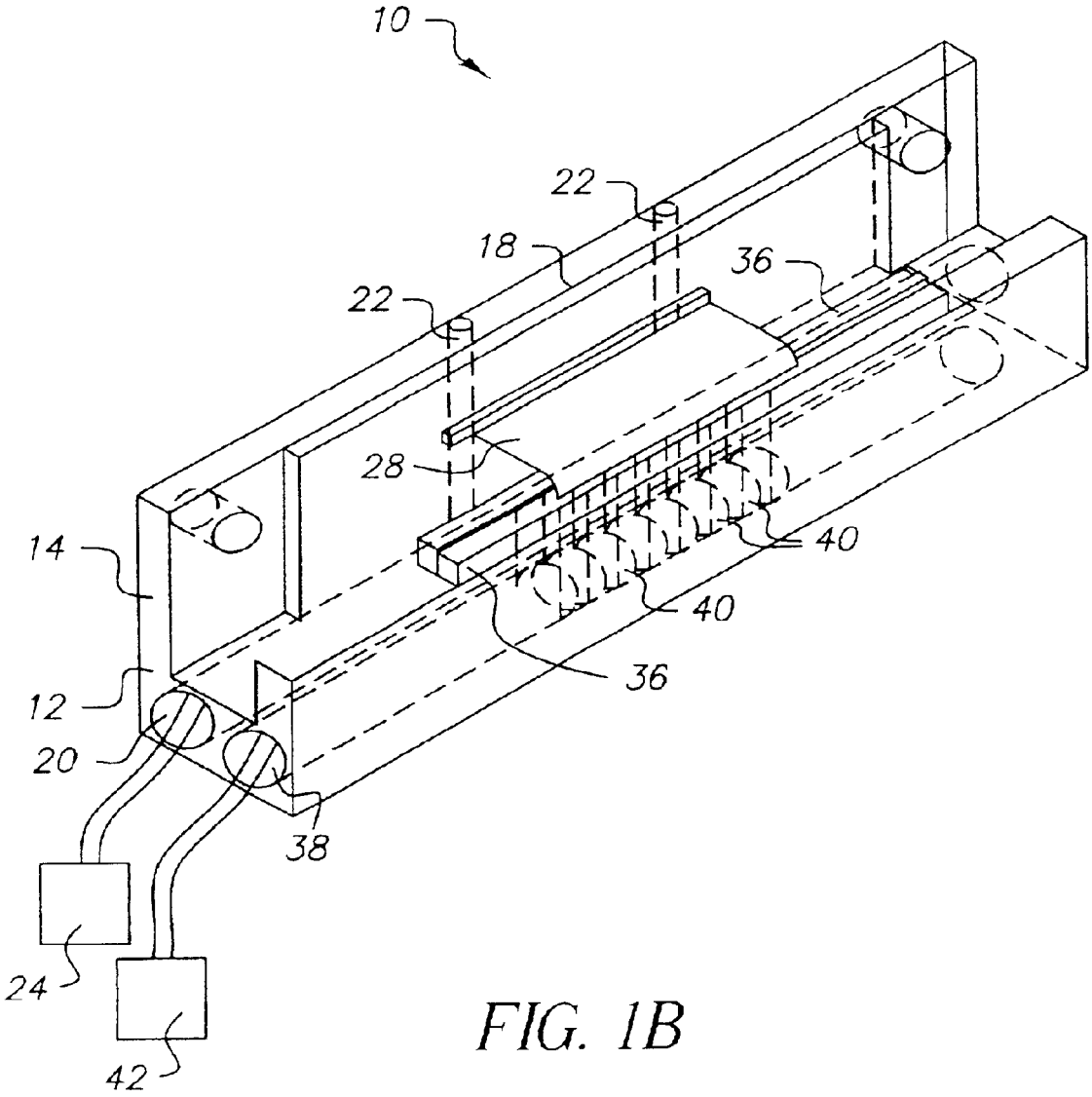
FIG. 1B is a perspective view of the embodiment shown in FIG. 1A attached to a printhead and showing internal fluid channels.

Referring to FIGS. 1A and 1B, an ink jet printhead 10 is shown. Ink jet printhead 10 includes a base 12 having an upper leg 14 extending from one end of base 12 and a lower leg 16 extending from another end of base 12. A nozzle plate 18 is mounted to upper leg 14 and is in fluid communication with ink manifold 20 through at least one ink delivery channel 22 (FIG. 1B) internally positioned within upper leg 14 and base 12 of printhead 10. A source of pressurized ink 24 is connected in fluid communication to nozzle plate 18 through ink manifold 20.

A porous catcher 34 having a delimiting edge 36 is mounted to lower leg 16. Porous catcher 34 is connected in fluid communication to vacuum manifold 38 through at least one ink removal channel 40 (FIG. 1B). A vacuum source 42 is connected to vacuum manifold 38. A recessed area 48 is positioned adjacent to delimiting edge 36 and serves as a collection area for accumulated ink 46, discussed in more detail below.

Figure 1C:
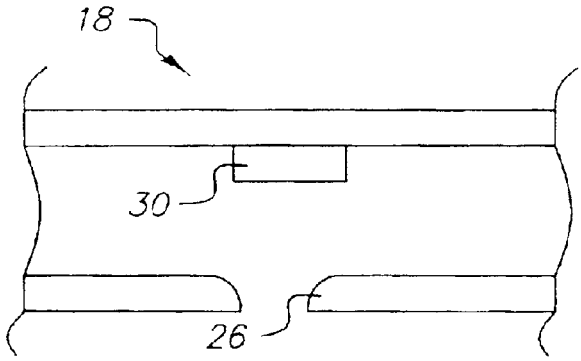
FIGS. 1C–1E are side views showing alternative positions for an ink drop forming mechanism.
Figure 1D:
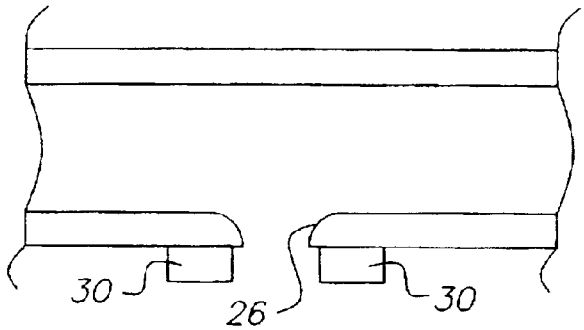
Figure 1E:
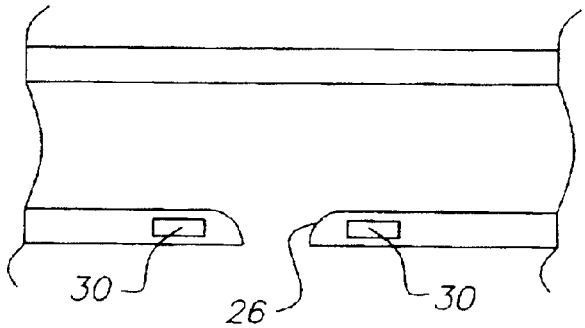

Referring to FIG. 1C, nozzle plate 18 has at least one bore 26 formed therein. Ink from the pressurized source 24 is ejected through bore 26 forming an ink stream 28. An ink drop forming mechanism 30 positioned proximate to bore 26 forms ink drops 32 from ink supplied by ink source 24. Ink drop forming mechanism can include thermal actuators, piezoelectric actuators, acoustic actuators, mechanical actuators, etc.

Figure 2A:
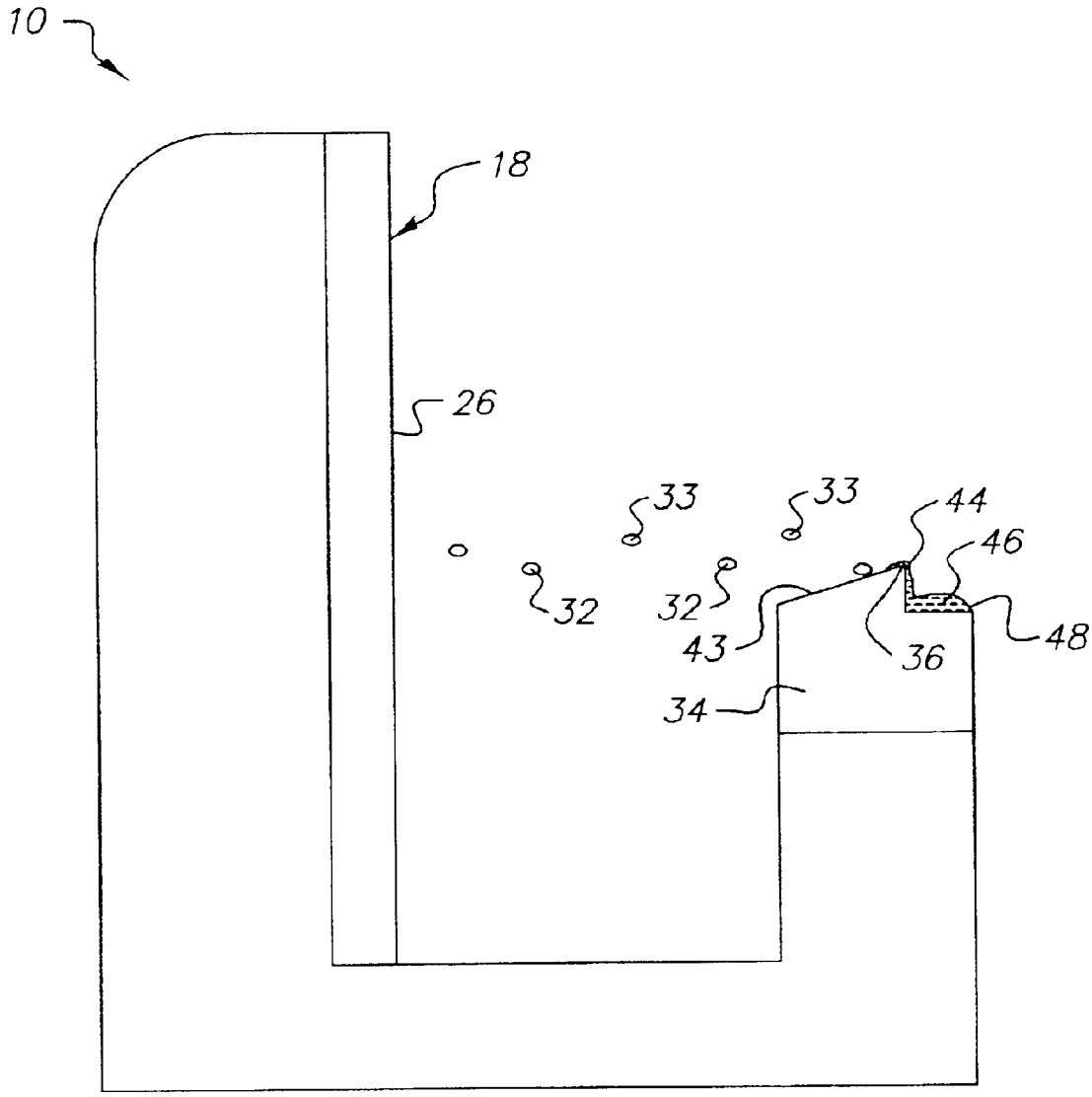
FIG. 2A is a side view of the embodiment shown in FIG. 1A attached to a printhead.
Figure 2B:
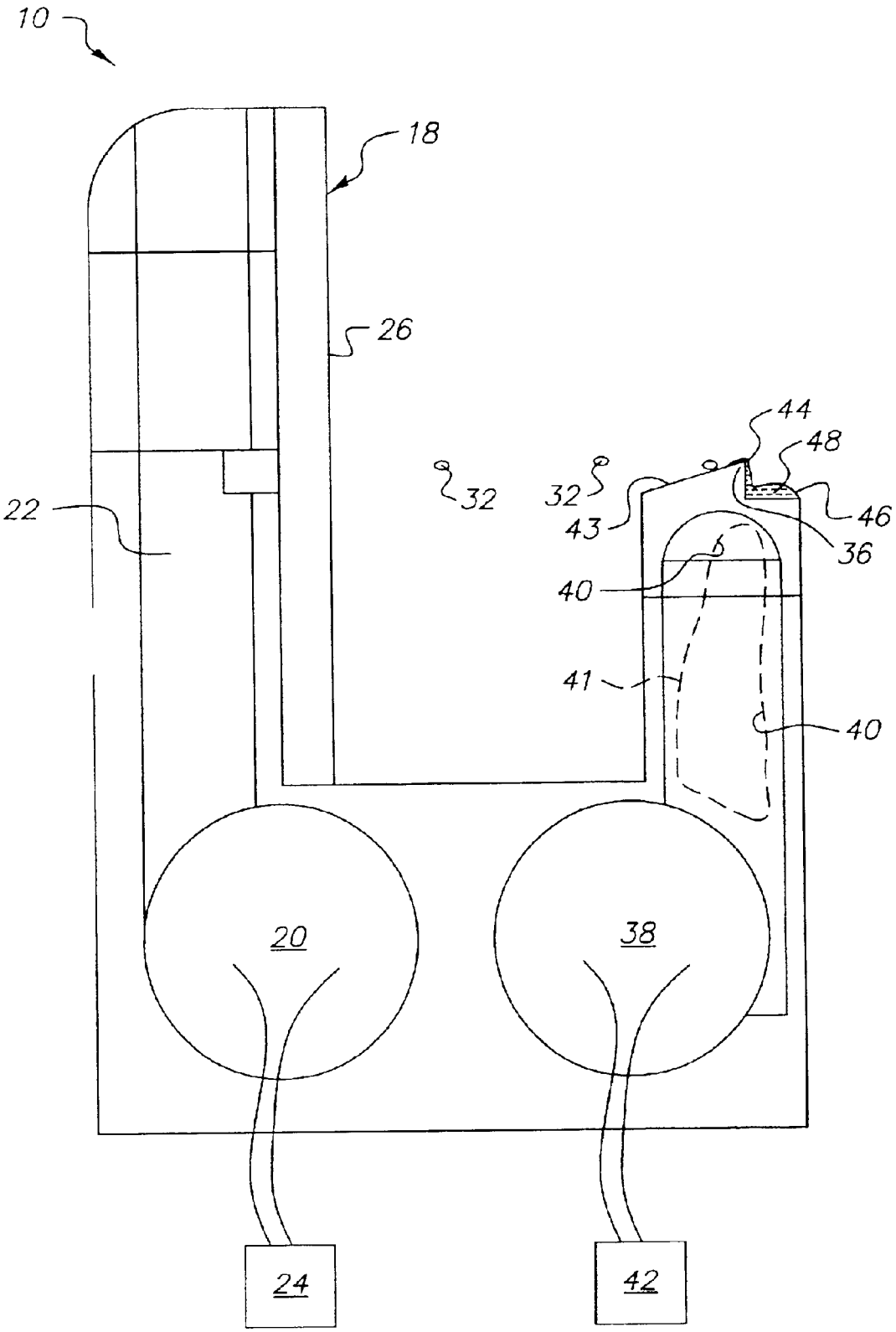
FIG. 2B is a side view of the embodiment shown in FIG. 1A attached to a printhead and showing internal fluid channels.

Referring to FIGS. 2A and 2B, in operation, pressurized ink from ink source 24 is routed through printhead 10 through ink manifold 20 and ink delivery channel(s) 22 to nozzle plate 18 and exits through bore(s) 26. Ink drop forming mechanism 30 forms ink drops 32, 33 from the ink ejected through bore(s) 26. An ink drop deflector system separates printing drops 33 from non-printing drops 32. Non-printing drops 32 impinge an oblique surface 43 of porous catcher 34 at or near a delimiting edge 36, forming a surface film 44 of ink over the delimiting edge 36 and an accumulation of ink 46 in recessed area 48 of porous catcher 34. The ink drop deflector system can include the system disclosed in U.S. Pat. No. 6,079,821, issued to Chwalek et al., and commonly assigned; electrostatic deflection; etc.

While in operation, a substantially constant volume surface of accumulated ink 46 remains along delimiting edge 36 while a larger substantially constant volume of accumulated ink 46 remains in recessed area 48 of porous catcher 34. Accumulated ink 46 is absorbed by the pores of porous catcher 34 and travels to vacuum manifold 38 through ink removal channel(s) 40 where the ink is collected for disposal or recycling. A slight vacuum (negative air pressure relative to ambient operating conditions) can be applied to assist with the ink removal. Additionally, an absorbent material 41 can be positioned in ink removal channel(s) 40 to assist with ink removal. Absorbent material 41 can occupy all of the area of the ink removal channel(s) 40 or a portion of the area of the ink removal channel(s) 40 depending on the particular printing application.

Absorbent material 41, shown in phantom in FIG. 2B, can be any porous material capable of absorbing fluid in an amount which is several times the weight of the absorbent material including paper, cloth, etc. Alternatively, the absorbent material can be a pad including a cellulosic material, such as one or more sheets or layers of cellulosic wadding or comminuted wood pulp (commonly referred to as wood fluff). For example, suitable absorbent materials can include a plurality of superposed plys of creped cellulose wadding and/or hydrophilic fiber aggregates prepared by either wet laying or air laying procedures well known in the art, and/or hydrophilic foams as disclosed in U.S. Pat. No. 3,794,029. Upon wetting of the absorbent material from an upwardly facing side, a wicking sheet or layer distributes moisture across a relatively large surface of the portion of the cellulostic wadding. Alternatively the absorbent sheets or layers can include any highly absorbent synthetic fibers, woven, non-woven or porous materials. Examples include mats or batts of synthetic fibers, mixtures of synthetic fiber, non-woven cellulosic batts and/or open cell sponge-like sheets.

The absorbent layer(s) can alternately include a mat or mass of hydrophobic fibers wherein the liquid retaining function of the batt takes place along the large surface area of the fibers. Non-water wetting fibers such as Dacron and Nylon have the characteristic property of being non-water absorbent from the standpoint that water generally does not penetrate the fibers; however, such fibers have the characteristic of permitting fluids to wick along their surface. A batt of such fibrous material typically retains or holds a large quantity of liquid on its large surface area when disposed in batt arrangement.

Alternately, highly water-absorbable resins which can absorb fluid in an amount which is several times its own weight can be used as the absorbent material. Examples of such highly water-absorbable resins are a saponified product of a copolymer of a vinyl ester and an ethylenic unsaturated carboxylic acid or the derivative thereof, a graft polymer of starch and acrylic acid, a cross-linked polyacrylic acid, a copolymer of vinyl alcohol and acrylic acid, a partially hydrolyzed polycrylonitrile, a cross-linked carboxymethyl cellulose, a cross-linked polyethylene glycol, the salt of chitosan, and a gel of pullulan. One of these substances can be used, or two or more of these substances can be combined in the form of a mixture.

Highly absorbent materials, such as hydrocolloid polymers, can also be used as the absorbent material. Hydrocolloid polymer materials permit a reduction in layer or sheet bulk while increasing desirable absorbent and fluid holding characteristics of the layer or sheet, as these materials are capable of absorbing and retaining many times their weight in liquid. These materials swell in contact with fluids to form a gelatinous mass. Hydrocolloid polymer materials can be utilized in a particulate form, such as granules or flakes, since the particles provide a greater exposed surface area for increased absorbency. Examples of hydrocolloid polymer materials include (a) hydrolyzed starch polyacrylonitrile copolymer H-span, Product 35-A-100, Grain Processing Corp., Muscatine, Iowa, disclosed in U.S. Pat. No. 3,661,815, (b) Product No. XD-8587.01L, which is cross-linked, Dow Corning Chemical Co., Midland, Mich., (c) Product No. SGP 502S, General Mills Chemical, Inc., Minneapolis, Minn., (d) Product No. 78-3710, National Starch and Chemical Corp., New York, N.Y., (e) a hydrogel base product, Carbowax, a trademark of Union Carbide Corp., Charleston, W. Va., or (f) base-saponisied starch-polyacrylonitrile and graft copolymers, United States Department of Agriculture, Peoria, Ill., disclosed in U.S. Pat. No. 3,425,971.

Figure 3A:
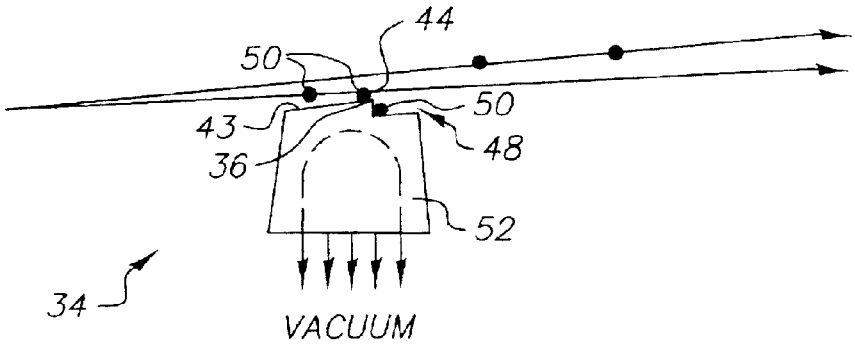
FIG. 3A is a side view of one preferred embodiment of the present invention shown in FIG. 1A.
Figure 3B:
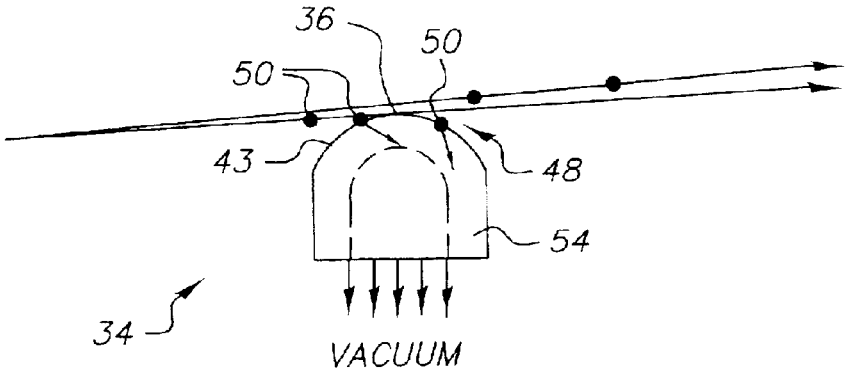
FIGS. 3B–3C are side views of alternative embodiments of the present invention shown in FIG. 3A.
Figure 3C:
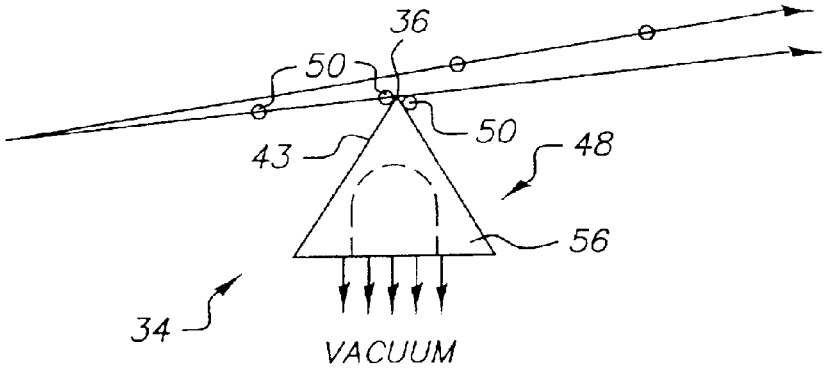

Referring to FIGS. 3A–3C, embodiments of porous catcher 34 are shown. FIG. 3A shows one preferred embodiment of porous catcher 34, commonly referred to as a rhomboid cross section catcher 52. Non-printing ink drops 50 impinge oblique face 43 of porous catcher 34 at or near delimiting edge 36, forming a surface ink film 44 at delimiting edge 36 and an accumulation furrow 46 in recessed area 48 of porous catcher 34. Recessed area 48 is substantially "L" shaped and extends over a predetermined length of at least a portion of a width dimension of porous catcher 34. Operation of catcher 52 is described above. Additionally, the geometry of catcher 52 allows for smaller pore size (2 to 7 micron pore diameter), as described below.

Figure 4:
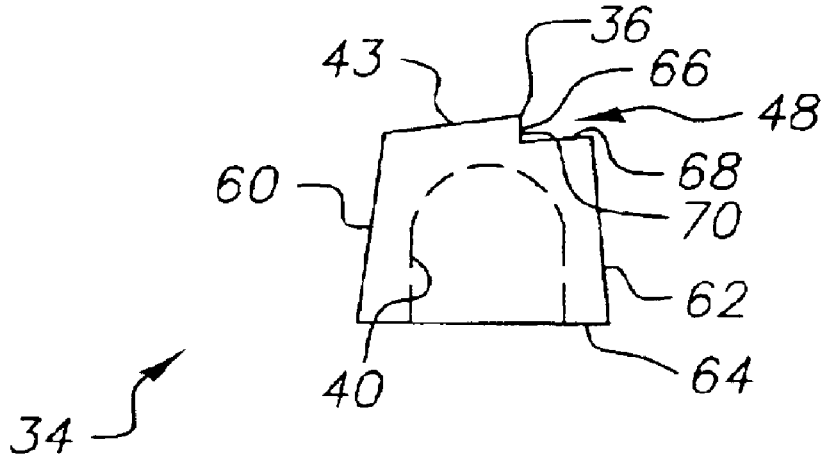
FIGS. 4 and 5 are side views of alternative embodiments of the present invention shown in FIG. 1A.

Referring to FIG. 4, catcher 52 includes a front surface 60 extending to oblique surface 43 which ends at a delimiting edge 36. Recessed area 48 begins at delimiting edge 36 and ends at bottom surface 64. Recessed area 48 includes a first surface 66 connected to a second surface 68 by an angle 70. Typically, first surface 66 extends toward bottom surface 64, thereby helping to define delimiting edge 36. However, first surface 66 does not have to extend toward bottom surface 64 in a perpendicular fashion, first surface 66 can extend toward bottom surface 64 at any appropriate angle. In a preferred embodiment, angle 70 is a right angle which is easily machined into the porous material of catcher 52. However, angle 70 can be acute or obtuse depending on the specific design of catcher 52. A portion of bottom surface 64 is machined away leaving an ink removal channel 40.

Referring back to FIGS. 3B and 3C, FIGS. 3B and 3C show a cylindrical cross section catcher 54 and a triangular cross section catcher 56, respectively, each having delimiting edge 36 and recessed area 48. Operation of catchers 54 and 56 is substantially similar to the operation of rhomboid cross section catcher 34, as described above.

In FIG. 3B, non-printing ink drops 50 impinge oblique face 43 of porous catcher 54 at or near delimiting edge 36, forming a surface ink film 44 at delimiting edge 36 and an accumulation furrow 46 in recessed area 48 of porous catcher 54. Recessed area 48 has a curved surface that extends over a predetermined length of at least a portion of a width dimension of porous catcher 54. In FIG. 3C, non-printing ink drops 50 impinge oblique face 43 of porous catcher 56 at or near delimiting edge 36, forming a surface ink film 44 at delimiting edge 36 and an accumulation furrow 46 in recessed area 48 of porous catcher 56. Recessed area 48 has a flat inclined surface relative to delimiting edge 36 that extends over a predetermined length of at least a portion of a width dimension of porous catcher 54.

Catcher 34 having sharp fluid jet delimiting characteristics, as described above, allows catcher 34 to be placed closer to the nozzle plate of an ink jet printer. This in turn reduces the distance a printed ink drop is required to travel which improves ink drop placement. As such, catcher 34 can be incorporated into the continuous ink jet printer disclosed in U.S. Pat. No. 6,079,821, issued to Chwalek et al., and commonly assigned. Alternatively, catcher 34 can be incorporated into continuous ink jet printers that use, for example, electrostatic deflection and either thermal, acoustic, or piezoelectric ink drop forming mechanisms, etc.

Catcher 34 acts as a sharp delimiter by controlling the fluid removal rate from the line of non-printed ink drop impact so as to maintain a thin, stable fluid film over the delimiting edge. The thin fluid film has several important functions. It serves to reduce the apparent roughness of the porous material and thereby define a straighter delimitation line. It reduces the air flow rate into the catcher, reducing jet deviation due to airflow and it aids in preventing secondary drop formation or misting as the ink drop impacts the gutter. Although the thickness of the thin fluid film should remain constant so as to maintain a stable delimiting edge location, the dimension associated with the thickness can vary depending on the application.

Under normal operating conditions, the catcher should remove the impinging fluid as fast as it is delivered. For example, fluid drops having an approximate diameter of 25 $\mu$m, impinging normal to a flat catcher face at 10 m/s, require a catcher having a specific flow capacity of at least 0.5 $ml/s/mm^2$. This specific flow rate can be achieved through the use of a very porous catcher material in combination with a strong vacuum force. However, a strong vacuum force aspirates a large amount of air which can lead to a reduction in print quality. In order to avoid this situation, porous catcher 34 geometrically distributes the impingement over a larger area of porous catcher 34 using tangential or oblique impingement surface. Additionally, porous catcher 34 utilizes capillary action and a hydrophilic material to distribute the fluid over a larger area of porous catcher 34 to create a three-dimensional flow field. Additionally, porous catcher 34 can accelerate the dispersed fluid flow away from the impingement zone through the use of a reduced amount of vacuum.

Porous catcher 34 can be made from any porous material. Preferably, the porous material will have a penetrable surface with a feature size considerably smaller than the drop size with a large percent of open area to allow immediate volume flow away from the impact point and to minimize impact energy. Porous ceramic, alumina, plastic, polymeric, carbon, and metal materials exist that meet the porosity and feature size criteria. Available ceramic materials have additional advantages including dimensional stability, being easily manufactured without closing the pores, being hydrophilic, and being chemically inert to a wide variety of fluids. This is particularly advantageous when anionic inks are being used, as anionic inks will plate positively charged surfaces effectively clogging the catcher and preventing fluid removal. Porous alumina is chemically inert and anionic. As such, the potential for clogging is reduced. Materials of this type are commercially available from Ferros Ceramic Products and Refractron Technologies.

Alternatively, and referring to FIG. 4, catcher 34 can be formed with surfaces having different porosity. For example, front surface 60 and/or back surface 62 of catcher 34 can have lower porosity than oblique surface 43 and recessed area 48 of catcher 34. Typically, this is done to focus the vacuum force to the surfaces having the highest ink flow rates. While maximizing the vacuum force to specific surfaces of catcher 34, focusing the vacuum force reduces ink drop misdirection due to extraneous air flow created by the vacuum force around and into catcher 34. Even though vacuum force to these surfaces is reduced, it is still advantageous to have these surfaces made of a porous material to help control ink accumulation on these surfaces. Catcher surfaces having different porosity can be accomplished by incorporating material particles of different sizes on the surface(s); incorporating a porous polymer into the material during the manufacturing process; coating the surface(s) with a porous polymer; coating the surface(s) with fine alumina particles suspended in a carrier; etc.

Figure 5:
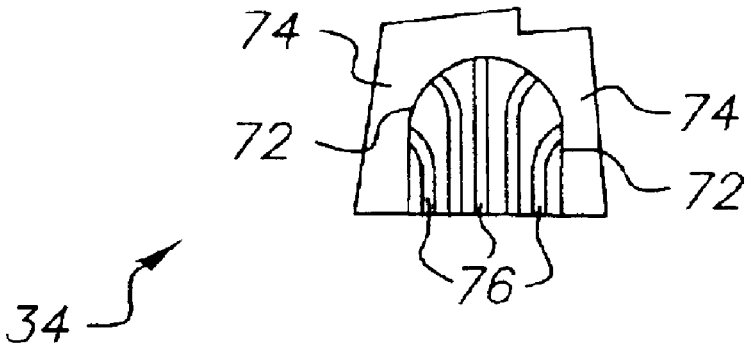

Referring to FIG. 5, catcher 34 can also be made with a non-porous material base 72 covered by a porous material shell 74. Non-porous material base 72 has at least on channel 76 in fluid communication with porous material shell 74 allowing accumulated ink to be removed from the surface(s) of catcher 34 through non-porous material base 72 for recycling or disposal. Vacuum can also be used to assist with the ink removal process.

Porous catcher 34 also minimizes secondary drop formation (commonly referred to as misting). When an ink drop traveling at speeds approaching 10 m/s strikes a planer surface, the impact energy is high enough to cause the creation of smaller sub-drops in the form of a mist. Porous catcher 34 utilizes at least three features including a thin fluid film, a small surface feature size, and a vacuum assisted flow in order to reduce the impact energy and the formation of mist without adversely affecting printed ink drop trajectories.

A thin fluid film on the surface of porous catcher 34 has a high surface affinity to incoming drops of the same composition. The drops "wet" the hydrophilic surface film and are attracted to thin fluid film by strong surface energy forces. The fluid film additionally acts as an elastic medium to greatly reduce the peak deceleration forces of a drop. This results in a greatly reduced potential for mist formation.

The surface feature size of the porous catcher is considerably smaller than the size of the drops and thereby distributes the impact over a larger time interval to substantially reduce the impact energy. Additionally, the inclined face of the vacuum assisted porous gutter provides an internal flow direction at the point of impact that is substantially parallel to the drop velocity vector. This results in reduced impact energy, especially during system start-up before a fluid film is established to reduce the formation of mist.

The amount of vacuum used in conjunction with catcher 34 is significantly reduced (by a factor of three in some cases) as compared with vacuum amounts used with other catcher designs. As such, an amount of vacuum assisted air flow can be applied to catcher 34 that is sufficient to reduce ink drop impact energy and the formation of mist without adversely affecting printed ink drop trajectories or creating unreasonable amounts of noise.

Figure 6:
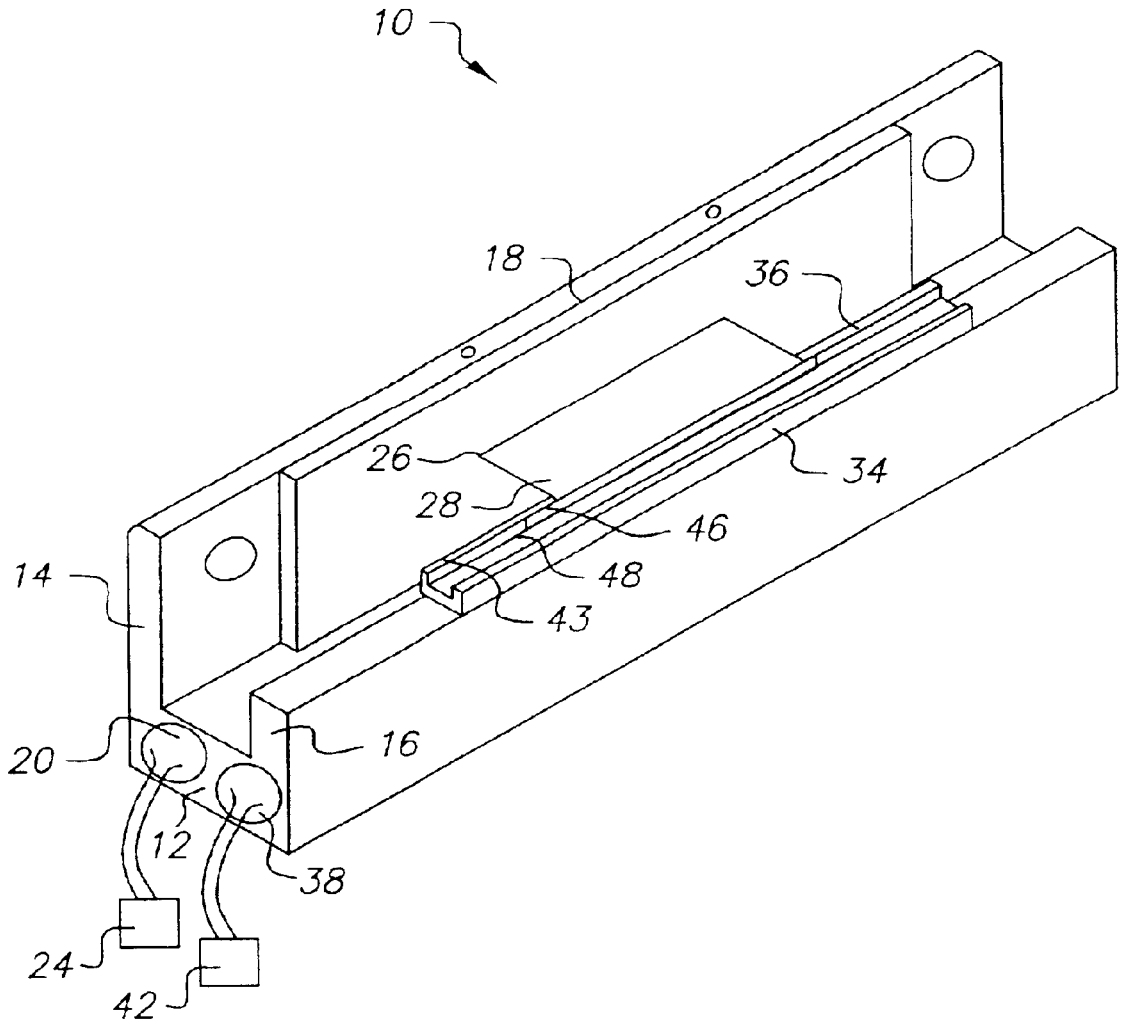
FIGS. 6 and 7 are perspective views of an alternative preferred embodiment of the present invention attached to a printhead.
Figure 7:
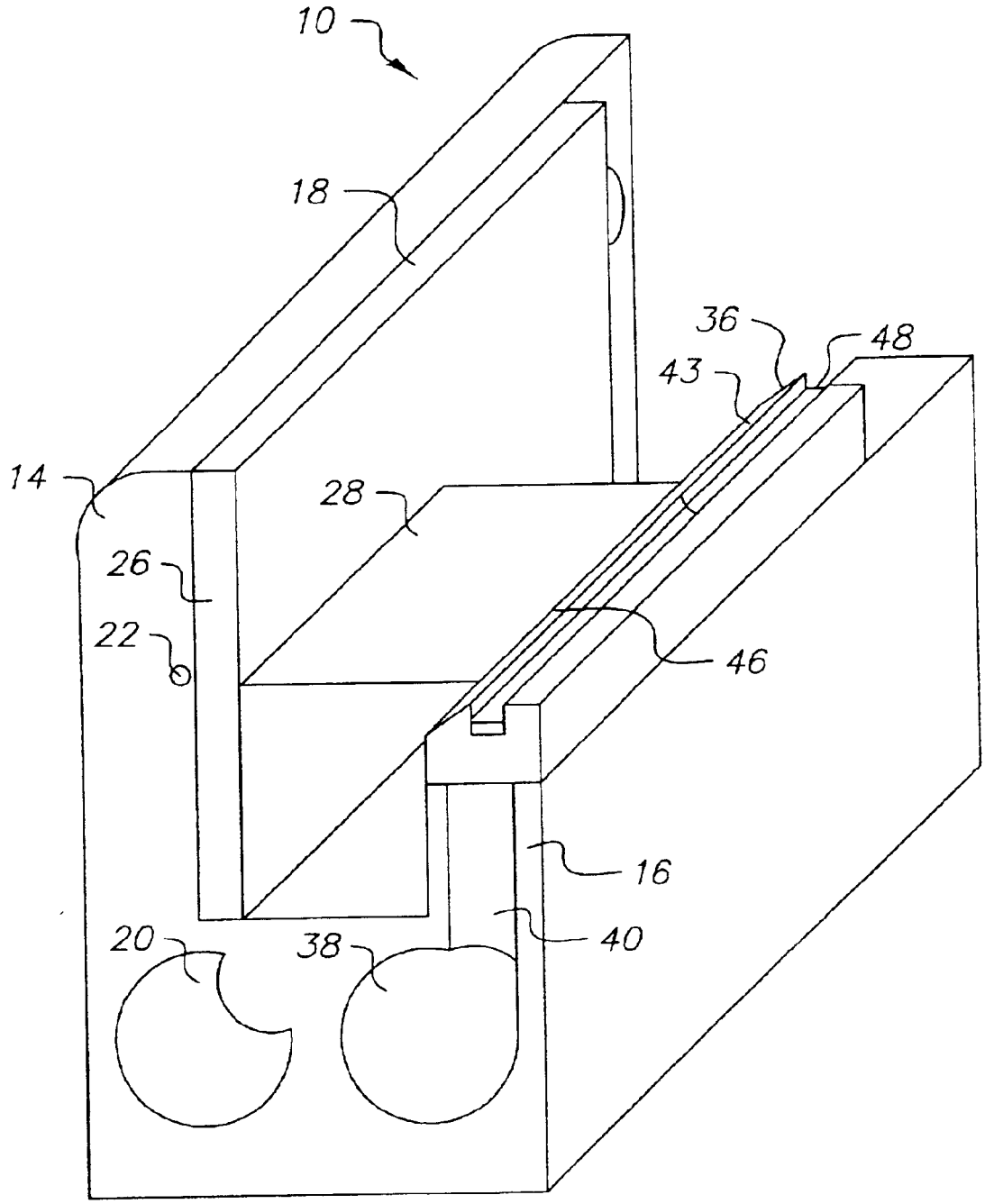
Figure 8:
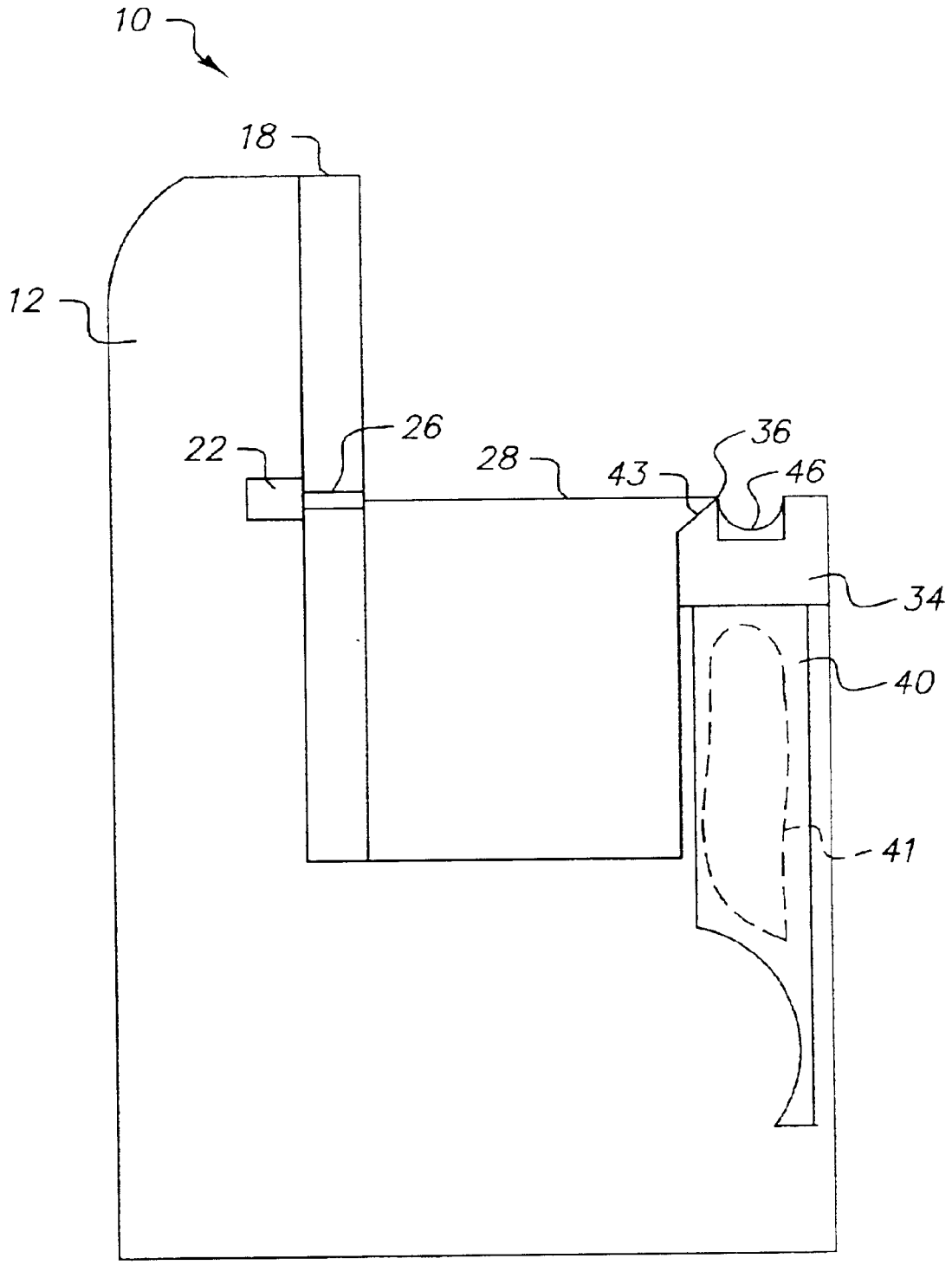
FIG. 8 is a side view of the embodiment shown in FIGS. 6 and 7 attached to a printhead.

Referring to FIGS. 6–8, an ink jet printhead 10 is shown incorporating an alternative preferred embodiment of catcher 34. Features similar to the features described with reference to FIGS. 1 and 2 are described with reference to FIGS. 6–8 using like reference symbols.

Ink jet printhead 10 includes a base 12 having an upper leg 14 extending from one end of base 12 and a lower leg 16 extending from another end of base 12. A nozzle plate 18 is mounted to upper leg 14 and is in fluid communication with ink manifold 20 through at least one ink delivery channel 22 internally positioned within upper leg 14 and base 12 of printhead 10. A source of pressurized ink 24 is connected in fluid communication to nozzle plate 18 through ink manifold 20.

A porous catcher 34 having a delimiting edge 36 is mounted to lower leg 16. Porous catcher 34 is connected in fluid communication to vacuum manifold 38 through at least one ink removal channel 40. A vacuum source 42 is connected to vacuum manifold 38. A recessed area 48 is positioned adjacent to delimiting edge 36 and serves as a collection area for accumulated ink 46, discussed in more detail below.

In operation, pressurized ink from ink source 24 is routed through printhead 10 through ink manifold 20 and ink delivery channel(s) 22 to nozzle plate 18 and exits through bore(s) 26. Ink drop forming mechanism 30 forms ink drops 32, 33 from the ink ejected through bore(s) 26. An ink drop deflector system separates printing drops 33 from non-printing drops 32. Non printing drops 32 impinge an oblique surface 43 of porous catcher 34 at or near a delimiting edge 36, forming a surface film 44 of ink over the delimiting edge 36 and an accumulation of ink 46 in recessed area 48 of porous catcher 34.

While in operation, a substantially constant volume surface of accumulated ink 46 remains along delimiting edge 36 while a larger substantially constant volume of accumulated ink 46 remains in recessed area 48 of porous catcher 34. Accumulated ink 46 is absorbed by the pores of porous catcher 34 and travels to vacuum manifold 38 through ink removal channel(s) 40 where the ink is collected for disposal or recycling. A slight vacuum (negative air pressure relative to ambient operating conditions) is applied to assist with the ink removal. Additionally, an absorbent material 41, shown in phantom in FIG. 8, can be positioned in ink removal channel(s) 40 to assist with ink removal. Absorbent material 41 can occupy all of the area of the ink removal channel(s) 40 or a portion of the area of the ink removal channel(s) 40 depending on the particular printing application. Absorbent material 41 can be any porous material capable of absorbing fluid in an amount which is several times the weight of the absorbent material as discussed above.

Figure 9A:
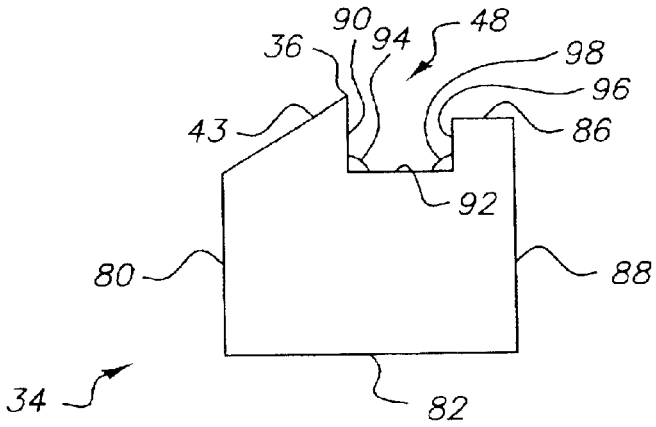
FIG. 9A is a side view of an alternative preferred embodiment of the present invention shown in FIGS. 6 and 7.

Referring to FIG. 9A, catcher 34 includes a front surface 80 extending from a bottom surface 82 and ending at an oblique surface 84. Oblique surface 43 extends upwardly ending at delimiting edge 36. Recessed area 48, positioned adjacent to delimiting edge 36, begins at delimiting edge 36 and ends at a border portion 86 of catcher 34. Border portion 86 includes back surface 88. Recessed area 48 begins at delimiting edge 36 and ends at bottom surface 64. Recessed area 48 includes a first surface 90 connected to a second surface 92 by a first angle 94. Second surface 92 is connected to third surface 96 by a second angle 98. Typically, first surface 90 extends toward bottom surface 82, thereby helping to define delimiting edge 36. However, first surface 90 does not have to extend toward bottom surface 82 in a perpendicular fashion, first surface 90 can extend toward bottom surface 82 at any appropriate angle. Third surface 96 extends toward the plane in which delimiting edge 36 is located ending at border portion 86 of catcher 34. In a preferred embodiment, first and second angles 94 and 98 are right angles which are easily machined into the porous material of catcher 34. However, first and second angles 94 and 98 can be acute or obtuse depending on the specific design of catcher 34.

Figure 9B:
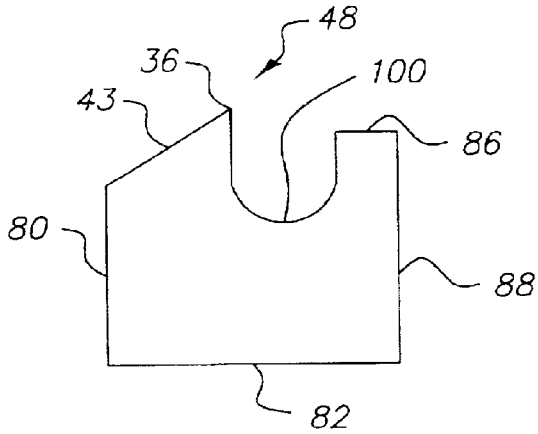
FIGS. 9B–9C are side views of alternative embodiments of the present invention shown in FIG. 9A.
Figure 9C:
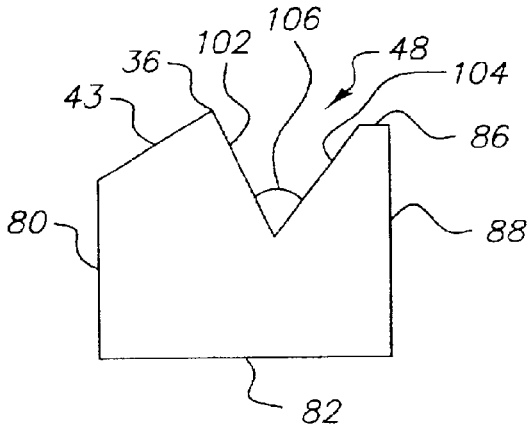

Referring to FIGS. 9B and 9C, alternative embodiments are shown. In FIG. 9B, recessed area 48 includes a surface 100 beginning at delimiting edge 36 and ending at border portion 86. When viewed in cross section, surface 100 is substantially cylindrical. Catcher 34 in FIG. 9B also includes front surface 80 extending from back surface 82 to oblique surface 43. Oblique surface 43 extends downwardly ending at delimiting edge 36. In FIG. 9C, recessed area 48 includes surfaces 102 and 104 joined by an angle 106. Surface 102 begins at delimiting edge 36 while surface 104 end at border portion 86. When viewed in cross section surfaces 102 and 104 and angle 106 define a substantially triangular region. Catcher 34 in FIG. 9C also includes front surface 80 extending from back surface 82 to oblique surface 43. Oblique surface 43 extends downwardly ending at delimiting edge 36.

In these embodiments, no ink removal channel 40 is machined into bottom surface 82. However, vacuum force is still present on all surfaces of catcher 34 because the profile of catcher 34 has been reduced as compared to the profile of catcher 34 described with reference to FIGS. 1 and 2. Alternatively, a portion of bottom surface 82 can be machined away leaving an ink removal channel 40. Additionally, these embodiments can incorporate surfaces having different porosity, as described above with reference to FIG. 4, and can incorporate non-porous material bases having porous material shells, as described above with reference to FIG. 5.

Figure 10:
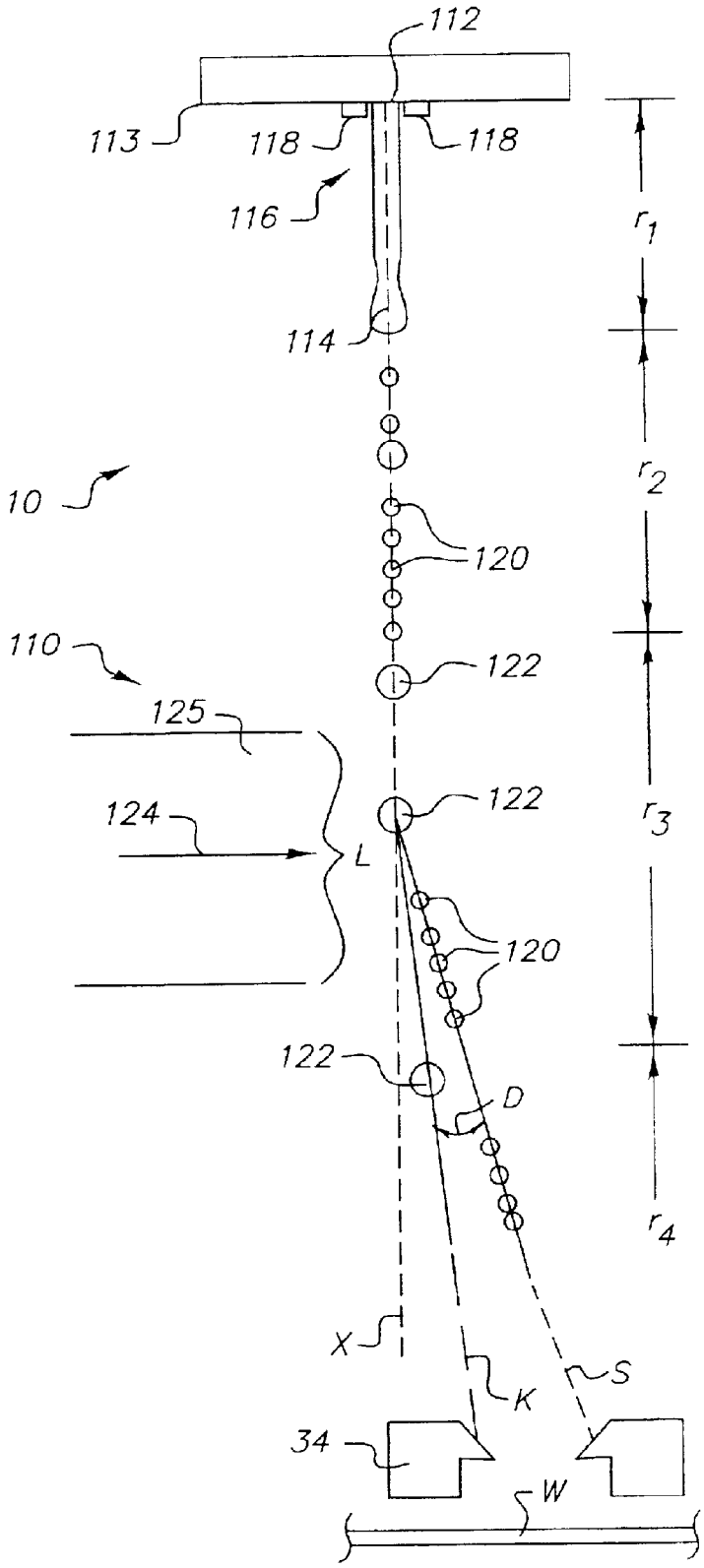
FIG. 10 is a schematic view of the present invention and a printhead.

In addition to the applications discussed above, porous catcher 34 finds application in other continuous ink jet printers. Referring to FIG. 10, a printhead 10 is coupled with a system 110 which separates drops into printing or non-printing paths according to drop volume. Ink is ejected through nozzle 18 formed in a surface 113 of printhead 10, creating a filament of working fluid 114 moving substantially perpendicular to surface 113 along axis X. The physical region over which the filament of working fluid 114 is intact is designated as $r_1$. Ink drop forming mechanism 116, typically a heater 118, is selectively activated at various frequencies according to image data, causing filament of working fluid 114 to break up into a stream of individual ink drops 120, 122. Some coalescence of ink drops can occur while forming ink drops 122. This region of jet break-up and drop coalescence is designated as $r_2$. Following region $r_2$, drop formation is complete in region $r_3$, such that at the distance from surface 113 that the system 110 is applied, ink drops 120, 122 are substantially in two size classes, small drops 120 and large drops 122 (as determined by volume and/or mass). In the preferred implementation, system 110 includes a force 124 provided by a gas flow substantially perpendicular to axis X. The force 124 acts over distance L, which is less than or equal to distance $r_3$. Typically distance L is defined by system portion 125. Large drops 122 have a greater mass and more momentum than small volume drops 120. As gas force 124 interacts with the stream of ink drops, the individual ink drops separate depending on each drops volume and mass. Accordingly, the gas flow rate can be adjusted to sufficient differentiation D in the small drop path S from the large drop path K, permitting large drops 122 to strike print media W while small drops 120 are captured by an ink catcher structure described below. Alternatively, small drops 120 can be permitted to strike print media W while large drops 122 are collected by slightly changing the position of the ink catcher.

Porous catcher 34 is positioned to collect either the large volume drops or the small volume drops depending on the particular printing application. This includes positioning only one porous catcher in one drop path or positioning two porous catchers 34 as shown. When printhead 10 includes two porous catchers 34, the gas flow rate is appropriately adjusted such that the desired size of ink drops is permitted to strike print media W.

An amount of separation D between the large drops 122 and the small drops 120 will not only depend on their relative size but also the velocity, density, and viscosity of the gas flow producing force 124; the velocity and density of the large drops 122 and small drops 120; and the interaction distance (shown as L in FIG. 3) over which the large drops 122 and the small drops 120 interact with the gas flow 124. Gases, including air, nitrogen, etc., having different densities and viscosities can also be used with similar results.

The invention has been described in detail with particular reference to certain preferred embodiments thereof, but it will be understood that variations and modifications can be effected within the scope of the invention, as is intended to be encompassed by the following claims and their legal equivalents.

What is claimed is:

1. A catcher comprising:

a body made from a porous material and having a first, second, and third portion, the first portion of the body defining a delimiting edge, the second portion of the body defining an area recessed from the delimiting edge, the third portion of the body being positioned adjacent to the second portion of the body and extending away from the recessed area such that the second portion of the body and the third portion of the body form an ink accumulation area, wherein the delimiting edge defines a non-printed drop path and a printed drop path.

2. The catcher according to claim 1, wherein the porous material is an alumina material.

3. The catcher according to claim 1, wherein the porous material is a ceramic material.

4. The catcher according to claim 1, wherein the porous material is a plastic material.

5. The catcher according to claim 1, wherein the porous material is a metal material.

6. The catcher according to claim 1, wherein the porous material is a carbon material.

7. The catcher according to claim 1, wherein a fourth portion of the body defines an oblique surface beginning at a location removed from the delimiting edge and ending at the delimiting edge.

8. A catcher comprising:

a body made from a porous material and having a first, second, and third portion, the first portion of the body defining a delimiting edge, the second portion of the body defining an area recessed from the delimiting edge, the third portion of the body being positioned adjacent to the second portion of the body and extending away from the recessed area such that the second portion of the body and the third portion of the body form an ink accumulation area, wherein the area recessed from the delimiting edge includes a surface beginning at the delimiting edge and ending at a location removed from the edge.

9. The catcher according to claim 8, wherein the surface of the area recessed from the delimiting edge is substantially planer.

10. The catcher according to claim 8, wherein a portion of the surface of the area recessed from the delimiting edge is curved.

11. The catcher according to claim 8, wherein the surface of the area recessed from the delimiting edge includes a first section and a second section, the first section being positioned at a first angle relative to the second section.

12. The catcher according to claim 11, wherein the first angle is substantially a right angle.

13. The catcher according to claim 11, wherein the first angle is an acute angle.

14. The catcher according to claim 11, wherein the first angle is an obtuse angle.

15. The catcher according to claim 11, wherein the surface of the area recessed from the delimiting edge includes a first surface of the third potion of the body, the first surface of the third portion of the body being positioned at a second angle relative to the second section of the surface of the area recessed from the delimiting edge.

16. The catcher according to claim 15, wherein the second angle is substantially a right angle.

17. The catcher according to claim 15, wherein the second angle is an acute angle.

18. The catcher according to claim 15, wherein the second angle is an obtuse angle.

19. A catcher comprising:

a body having delimiting edge made from a porous material, a recessed area made from a porous material, and a border made from a porous material, the recessed area being positioned between the delimiting edge and the border, wherein the delimiting edge defines a non-printed drop path and a printed drop path.

20. The catcher according to claim 19, further comprising:

a channel positioned proximate to the delimiting edge and the recessed area, the channel being in fluid communication with the delimiting edge and the recessed area.

21. The catcher according to claim 20, further comprising:

a vacuum source providing a vacuum force connected to the channel, a portion of the vacuum force being located at the delimiting edge and the recessed area.

22. The catcher according to claim 20, further comprising:

a vacuum source providing a vacuum force connected to the channel, a portion of the vacuum force being distributed throughout the body.

23. The catcher according to claim 20, further comprising:

an absorbent material positioned in the channel.

24. The catcher according to claim 23, wherein all surfaces of the body are in fluid communication with the absorbent material through capillary action created by pores of the porous material.

25. The catcher according to claim 19, the delimiting edge having a first porosity, the border having a second porosity, wherein the first porosity is greater than the second porosity.

26. The catcher according to claim 25, the recessed area having a third porosity, wherein the third porosity is greater than the second porosity.

27. The catcher according to claim 25, the recessed area having a third porosity, wherein the third porosity is substantially equal to the first porosity.

28. An apparatus for printing an image comprising:

a printhead, portion of the printhead defining a nozzle;

a droplet forming mechanism positioned proximate to the nozzle and being operable to eject an ink droplets along a droplet path;

a droplet steering mechanism positioned proximate to the droplet path and being operable to apply a force to the ink droplets travelling along the droplet path, the force being applied such that the ink droplet begins travelling along one of a printing droplet path and a non-printing droplet path; and a catcher positioned in the non-printing droplet path spaced apart from the droplet steering mechanism, the catcher including a body having delimiting edge made from a porous material, a recessed area made from a porous material, and a border made from a porous material, the recessed area being positioned between the delimiting edge and the border, wherein the delimiting edge defines a non-printing droplet path and a printing droplet path.

29. The apparatus according to claim 28, wherein the catcher includes an oblique surface positioned in the non-printing droplet path, the oblique surface ending at the delimiting edge, the delimiting edge being positioned between the oblique surface and the recessed area.

30. The apparatus according to claim 28, further comprising:

a channel positioned proximate to the delimiting edge and the recessed area, the channel being in fluid communication with the delimiting edge and the recessed area.

31. The apparatus according to claim 30, further comprising:

a vacuum source providing a vacuum force connected to the channel, a portion of the vacuum force being located at the delimiting edge and the recessed area.

32. The catcher according to claim 30, further comprising:

an absorbent material positioned in the channel.

33. The catcher according to claim 28, further comprising:

a vacuum source providing a vacuum force connected to the catcher, a portion of the vacuum force being distributed throughout the body.

34. A method of manufacturing a catcher comprising:

providing a body;

forming a delimiting edge on a first portion of the body, the delimiting edge being made from a porous material;

forming a recessed area on a second portion of the body adjacent to the delimiting edge, the recessed area being made from a porous material;

forming a border on a third portion of the body adjacent to the recessed area, the border being made from a porous material; and forming an oblique surface on a fourth portion of the body beginning at a location removed from the delimiting edge and ending at the delimiting edge, the oblique surface being made from a porous material.

35. The method according to claim 34, the delimiting edge being formed from a porous material having a first porosity, wherein forming the border on the third portion of the body includes forming the border from porous material having a second porosity, the first porosity being greater than the second porosity.

36. The method according to claim 35, the recessed area being formed from a porous material having a third porosity, wherein forming the border on the third portion of the body includes forming the border from porous material having the second porosity, the third porosity being greater than the second porosity.

37. A catcher comprising:

a body made from a porous material and having a first, second, and third portion, the first portion of the body defining a delimiting edge, the second portion of the body defining an area recessed from the delimiting edge, the third portion of the body being positioned adjacent to the second portion of the body and extending away from the recessed area such that the second portion of the body and the third portion of the body form an ink accumulation area, wherein a fourth portion of the body defines an oblique surface beginning at a location removed from the delimiting edge and ending at the delimiting edge.

38. An apparatus for printing an image comprising:

a printhead, portion of the printhead defining a nozzle;

a droplet forming mechanism positioned proximate to the nozzle and being operable to eject an ink droplets along a droplet path;

a droplet steering mechanism positioned proximate to the droplet path and being operable to apply a force to the ink droplets travelling along the droplet path, the force being applied such that the ink droplet begins travelling along one of a printing droplet path and a non-printing droplet path; and a catcher positioned in the non-printing droplet path spaced apart from the droplet steering mechanism, the catcher including a body having delimiting edge made from a porous material, a recessed area made from a porous material, and a border made from a porous material, the recessed area being positioned between the delimiting edge and the border, wherein the catcher includes an oblique surface positioned in the non-printing droplet path, the oblique surface ending at the delimiting edge, the delimiting edge being positioned between the oblique surface and the recessed area.

* * * * *